United States Patent [19]

Ayano et al.

[11] Patent Number: 5,040,707

[45] Date of Patent: Aug. 20, 1991

[54] HANGER FOR JACKET AND TROUSERS WITH CLAMPING TROUSER BAR

[75] Inventors: Norio Ayano; Masanori Ando, both of Kagawa, Japan

[73] Assignee: Kabushiki Kaisha Ayano Seisakusho, Japan

[21] Appl. No.: 583,330

[22] Filed: Sep. 17, 1990

[30] Foreign Application Priority Data

Sep. 22, 1989 [JP] Japan ..... 1-110976

[51] Int. Cl.[5] ..... A47G 25/48; A47G 25/44; A47G 25/18; A47G 25/14

[52] U.S. Cl. ..... 223/96; 223/95; 223/89; 223/88; 223/85; D6/326; D6/315

[58] Field of Search ..... 223/96, 95, 90, 89, 223/85, 88, 92, 93, 94; D6/315, 318, 319, 326

[56] References Cited

U.S. PATENT DOCUMENTS

| | | | |
|---|---|---|---|
| 1,730,620 | 10/1929 | Montgomery | 223/93 |
| 1,775,923 | 9/1930 | Adelson | 223/93 |
| 1,788,049 | 1/1931 | Duffie | 223/93 |
| 4,324,352 | 4/1982 | Goldfarb et al. | 223/93 X |
| 4,615,447 | 10/1986 | Walter | 223/95 X |

*Primary Examiner*—Werner H. Schroeder
*Assistant Examiner*—Bibhu Mohanty
*Attorney, Agent, or Firm*—Lorusso & Loud

[57] ABSTRACT

A device suitable for hanging a jacket and trousers is disclosed, which includes a main frame having an upper portion shaped to fit inside the jacket from shoulder to shoulder and a lower portion vertically spaced apart from the upper portion, a subframe having an upper part disposed between the upper and lower portions of the main frame and a lower part adapted for hanging the trousers, and a hook member having an end portion fixedly secured to the upper part of the subframe and a vertical extending portion slidably inserted through a through hole of the main frame, so that the subframe is movable relative to the main frame between a lower position where there is formed a space between the lower portion of the main frame and the lower part of the subframe to permit the trousers to be inserted therethrough and an upper position where the lower part of the subframe is engaged by the lower portion of the main frame to nip the trousers hung on the lower part of the subframe therebetween.

1 Claim, 6 Drawing Sheets

HANGER FOR JACKET AND TROUSERS WITH CLAMPING TROUSER BAR

BACKGROUND OF THE INVENTION

1. Field of the Invention

The present invention relates to a hanger used for hanging a suit or the like garment.

2. Prior Art

When clothes are hung on a hanger, normally a jacket is hung on an upper portion of a main frame and a pair of trousers and the like are hung on a lower portion thereof. Such a hanger is disclosed in Japanese Utility Model Laid-Open No. 63-169979/1988 and No. 1-90478/1989.

The hanger disclosed in Japanese Utility Model Laid-Open No. 63-169979/1988 is illustrated in FIGS. 5 and 6. The hanger is composed of a hanger main frame 101 and a lower frame 102 located in the lower portion thereof. In addition, on the upper surface of the lower frame 102 which comes into contact with the clothes, a skid-proof layer 102 (*a*) is formed in order to prevent the clothes from slipping off, and no skid-proof layer is formed at the lower side face of the lower frame 102. When this hanger is used, a jacket is hung on the hanger main frame 101, and a pair of trousers and the like are hung on the lower frame 102.

Furthermore, the hanger disclosed in Japanese Utility Model Laid-Open No. 1-90478/1989 is illustrated in FIG. 7. This hanger is provided with a hanger main frame 111, two vertically extending frames 112 and 112 respectively extending from both sides of the hanger main frame, a lower frame 113 each end of which is supported by the lower end of each of the vertically extending frames 112 and 112, and clothes supporter 114 provided on the lower frame 113 and facing the hanger main frame 111. The clothes supporter 114 has an end portion 114 (*a*) slidably engaged by the vertically extending frame 112 and a clothes supporting plate 114 (*b*). When this hanger shown in FIG. 7 is used, a jacket is hung on the hanger main frame 111 and a pair of trousers and the like are hung on the lower frame 113. The trousers and the like are pressed from the upper side by the clothes supporting plate 114 (*b*) of the clothes supporter 114.

In such kind of prior art hangers, no problem arises when a jacket is hung on the hanger main frame. However, some problems occur as shown below when a pair of trousers and the like are hung on the lower frame.

That is, in the prior art hanger as shown in FIGS. 5 and 6, when clothes (a pair of trousers and the like) 103, hung down on the lower frame 102 are taken off, it is necessary to reduce a friction force between the clothes 103 and the lower frame 102 in order to take up the clothes 103 at the side face of the skid-proof layer 102 (*a*). Thus, the clothes 103 must be disengaged from the skid-proof layer 102 (*a*) before pulling the clothes in the direction shown by the arrow A. Thus, when the clothes are taken off from the lower frame 102, a care must be paid to the direction of taking up the clothes, which is troublesome.

If a skid-proof layer is provided in the whole area of the upper side face of the lower frame 102, it becomes no need for paying an attention to the direction of taking up the clothes 103. In this case, however, the clothes 103 will stick to the area of skid-proof layer when the clothes 103 are taken off, which will result in an unsmooth taking off action. On the contrary, if no skid-proof layer is provided on the lower frame 102 at all, a problem is caused because the clothes 103 will be easily fallen down from the lower frame 102.

Moreover, in the prior art hanger shown in FIG. 7, the clothes 103 are put between the lower frame 113 and the clothes supporting plate 114 (*b*) of the clothes supporter 114. Therefore, in either case when the clothes 103 are hung on the lower frame 113 or they are taken off from it, the clothes supporter 114 must be slid up and down, which is troublesome.

SUMMARY OF THE INVENTION

Accordingly, it is an object of the present invention to provide an improved hanger which permits simple hanging and taking off action of a pair of trousers, a skirt or the like.

The present invention provides a device suitable for hanging a jacket and trousers, comprising: a main frame having an upper portion shaped to fit inside the jacket from shoulder to shoulder and a lower portion vertically spaced apart from and extending in the same direction with said upper portion, said upper portion having a vertically extending through hole in the center thereof; a subframe having an upper part disposed between said upper and lower portions of said main frame and a lower part adapted for hanging the trousers, said lower part being vertically spaced apart from said upper part and disposed beneath said lower portion of said main frame; and a hook member having an end portion fixedly secured to said upper part of said subframe and a vertical extending portion slidably inserted through said through hole with the other end thereof being protruded from said through hole and formed into a hook, so that said subframe is movable relative to said main frame between a lower position where there is formed a space between said lower portion of said main frame and said lower part of said subframe to permit the trousers to be inserted therethrough and an upper position where said lower part of said subframe is engaged by said lower portion of said main frame to nip the trousers hung on said lower part of said subframe therebetween.

According to the hanger of the present invention, when a person holds the hanger main frame with the subframe being kept free, the subframe moves downwards by its own-weight relative to the main frame. On the contrary, when the subframe is held, for instance by its hanging hook on a rail in a closet, the hanger main frame moves downwards by its own-weight relative to the subframe. When the hanger main frame is in a upwards moving position to the subframe (namely when the subframe is positioned in a lower position,) a space is formed between the upper surface of the lower subframe (lower part of the subframe) and the lower surface of the hung material supporter (lower portion of the main frame) to permit a hung material to be inserted therethrough for hanging on the lower subframe. On the contrary, when the hanger main frame is in a downwards moving position to the subframe (namely when the subframe is positioned in an upper position,) the hung material supporter can press the hung material from the upper side.

Accordingly, in use of the hanger according to the present invention, only a hold of the hanger main frame makes it possible to move the subframe downwards by its own-weight, and to form a space, through which a hung material can be inserted and hung, between the upper surface of the lower subframe and the lower surface of the hung material supporter. On the contrary, only a hold of the subframe (or the hanging hook) makes it possible to move the hanger main frame downwards by its ownweight, and to press the hung material hung on the lower subframe from the upper side by the hung material supporter. This makes the work simple, in hanging a hung material on the lower subframe, and secures a preferable hanging condition.

In addition, when a hanging hook is held after hanging a jacket on the hanger main frame in succession to a hang of a hung material on the lower subframe, the weight of the hung jacket is added to the weight of the hanger main frame, which will result in increasing the pressing force for the hung material by the hung material supporter, and thus the hanging condition of the hung material, hung on the lower subframe, is much more secured. Furthermore, when a hung material, hung on the lower subframe is taken off, only when the hanger main frame is held, the own weight of the subframe and the weight of the hung material, hung on the lower subframe, makes the subframe move downwards to the hanger main frame, which will result in forming a space between the upper surface of the lower subframe and the lower surface of the hung material supporter, and thus the taking off work, of the hung material from the hanger, becomes much more simplified.

DETAILED DESCRIPTION OF THE PREFERRED EMBODIMENTS

Two preferred embodiments of the present invention will be described referring to FIGS. 1 through 4.

Figure 1:
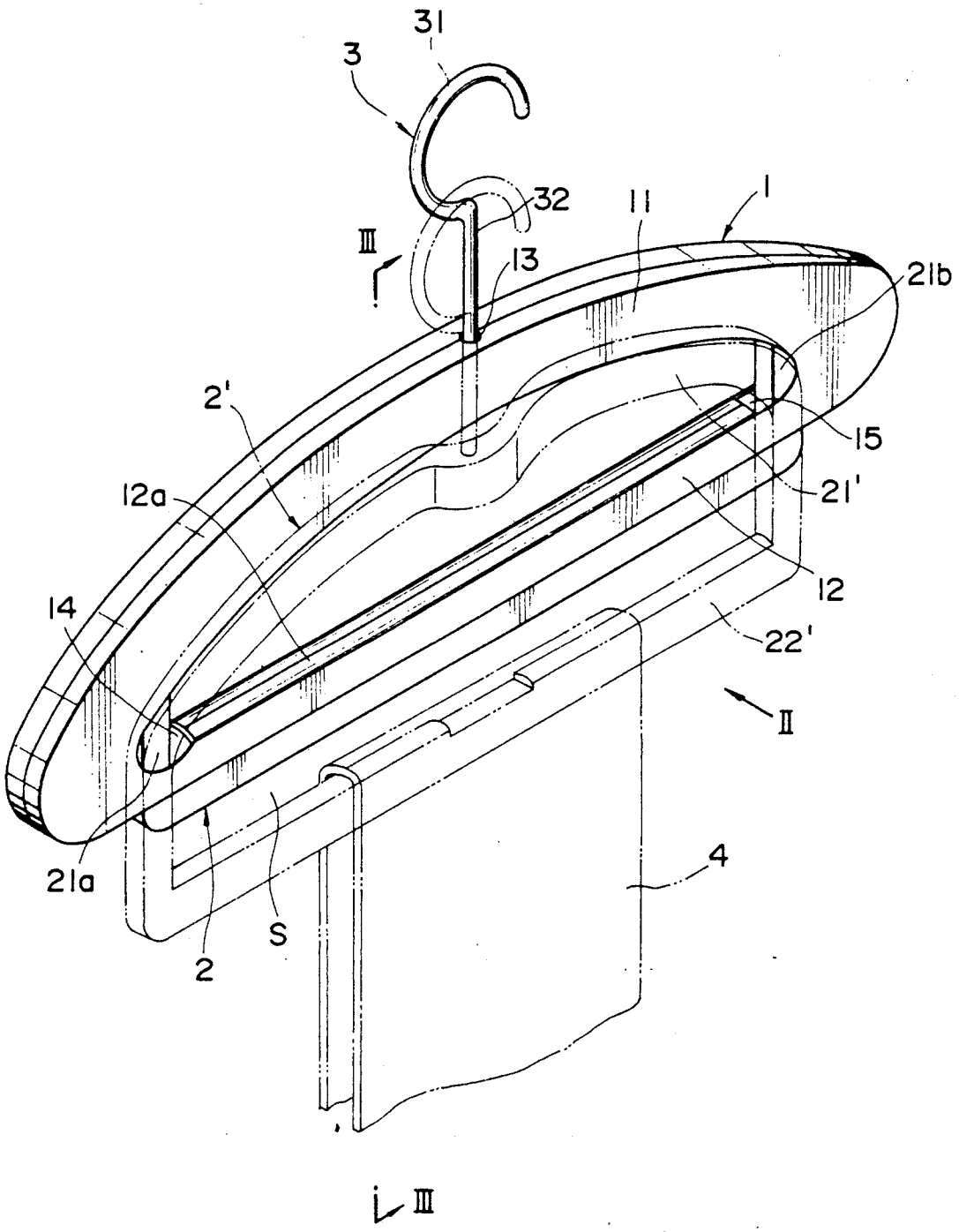
FIG. 1 is a perspective view of a hanger of one embodiment of the present invention.
Figure 2:
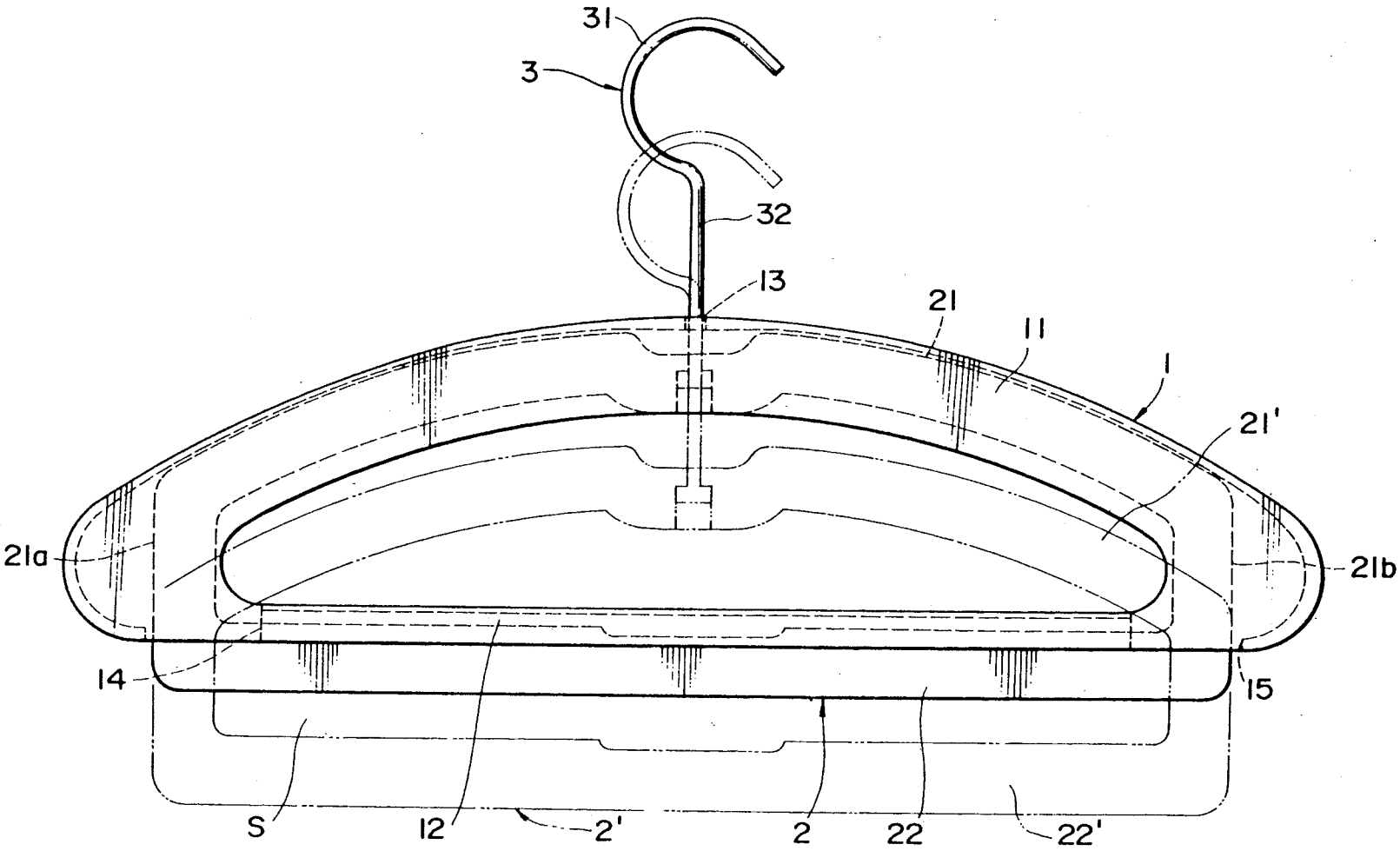
FIG. 2 is a front view from the direction of II in FIG. 1.
Figure 3:
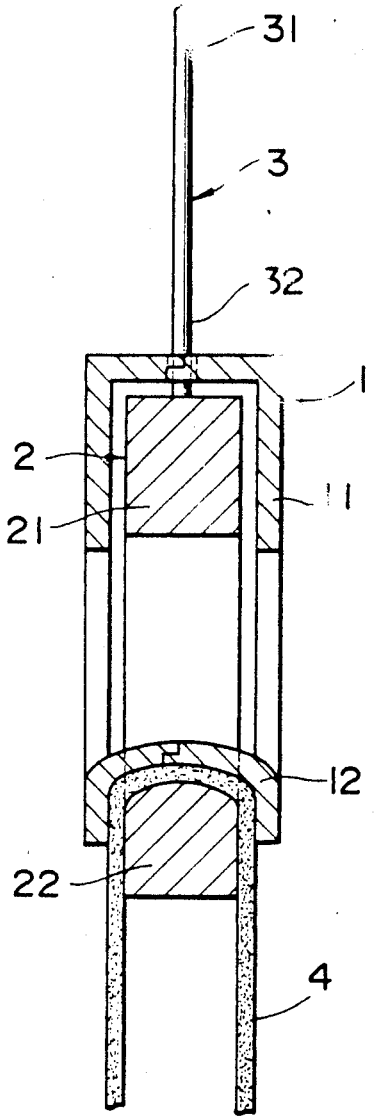
FIG. 3 is an enlarged, sectional view taken on the line III—III' in FIG. 1.

A hanger of the first embodiment, illustrated in FIGS. 1 through 3, is composed of a hanger main frame 1 and a subframe 2, respectively, made of a synthetic resin, metal, wood or any other desired material. The hanger main frame 1 and the subframe 2 are assembled in such a way that the subframe 2 is placed in the lower position, and the hanger main frame 1, in the upper position.

The subframe 2 is formed in such a way that an upper subframe (upper part) 21, and a lower subframe (lower part) 22, on which a user hangs a hung material 4 such as a pair of trousers and a towel, are separated with each other in a given space between the upper and lower portions, and are linked with each other at their right and left ends with a respective vertical type linkages 21 (*a*) and 21 (*b*), furthermore, a hanging hook 3 is mounted on the upper subframe 21 so that the hanging hook 3 is protruded to the upper direction. The hanging hook is composed of a vertically extending portion 32 with a given length at the lower side and a hook 31 at the upper side.

The hanger main frame 1 is composed of a jacket hanger (upper portion) 11 and a hung material supporter (lower portion) 12, located at the lower part of the jacket hanger 11 which presses the hung material 4, hung on the lower subframe 22 of the subframe 2, from its upper side. An inverted U-type hollow room is formed, respectively, in the inside of the jacket hanger 11 and the hung material supporter 12, so that the upper subframe 21 and lower subframe 22 can be inserted from the lower portion into the above said respective room, (see FIG. 3). Moreover, a penetrating hole 13 is formed through the central part of the upper portion of the jacket hanger 11, so that the vertically extending portion 32 of the hanging hook 3 can freely move up and down through the hole. In addition, penetration openings 14 and 15 are formed at the respective end of the subframe 2 of the hung material supporter 12, so that the respective linkage 21 (*a*) and 21 (*b*) can freely move up and down through the openings.

As stated above the hanger main frame 1 is located in the upper portion of the subframe 2. The vertically extending portion 32 of the hanging hook 3 mounted on the subframe 2 is penetrated through the penetrating hole 13 formed at the central part of the jacket hanger 11 of the hanger main frame 1, and the hook 31 is protruded upwards from the upper surface of the jacket hanger 11. Moreover, the hanger main frame 1 and the subframe 2 are assembled so as to be freely slidable up and down by their own-weight, by means of linkages 21 (*a*) and 21 (*b*) of the subframe 2 inserted through the penetration openings 14 and 15 formed at the both ends of the hung material supporter 12.

In addition, in this first example, the main frame 1 is divided into two parts widthwise, and the subframe 2 is put between the two divided parts of the hanger main frame 1 so that the main frame 1 and the subframe 2 are made inseparable. In addition, the lower subframe 22 of the subframe 2 and the hung material supporter 12 of the hanger main frame 1 assures a space S, between the upper portion of the lower subframe 22 and the lower portion of the hung material supporter 12, where a user can hang a hung material 4, when the hanger main frame 1 is in an upwards moving position to the subframe 2. On the contrary, when the hanger main frame 1 is in a downwards moving position to the subframe 2, the hang material supporter 12 is positioned in such a way that it presses down from the upper part the hung material 4 hung on the lower subframe 22.

Here, we will explain how to hang a hung material 4 such as a pair of trousers or a towel, by using the hanger in this first example. First, a user holds only the jacket hanger 11 of the hanger main frame 1 with his hand, and the subframe 2 is left in the condition of being freely movable up and down, then the subframe 2 will fall down by its own-weight to the lowest position (at this time, as shown by oblique lines, a part of the lower surface of the upper subframe 21' touches the upper surface of the hung material supporter 12). Thus, a space S, where a user can hang a hung material 4 on the lower subframe 22, is assured between the upper surface of the lower subframe 22 and the lower surface of the hung material supporter 12. When a user wants to hang a material on the lower subframe 22, first the material 4 to be hung is inserted into the space S and hung on the lower subframe 22, then the user holds the hook 31 of the hanging hook 3, and the hung material supporter 12 moves downwards by its own-weight to support, from the upper part, the hung material 4 hung on the lower subframe 22. This results in preventing the hung material 4 from unwittingly slipping off from the lower subframe 22, because the hung material 4 is put between the upper surface of the lower subframe 22 and the lower surface of the hung material supporter 12 (see FIG. 3). In addition, when a user hangs a jacket on the jacket hanger 11 of the hanger main frame 1, in such a condition that the hung material 4 has been hung, the weight of the jacket is added to the weight of the hanger main frame 1, which results in being pressed more strongly the hung material 4 hung on the lower subframe 22 by the lower surface of the hung material supporter 12, so as to hold more securely the hung material 4. Afterwards, when a user wants to take off the hung material 4 hung on the lower subframe 22, the process is proceeded in the reverse order of the above. That is, first a user holds, with his hand, the jacket hanger 11 of the hanger main frame 1, and the subframe 2 moves automatically downwards to the lowest position shown by the oblique lines 2' owing to the weight of the lower subframe 22 and the hung materials 4 hung on the lower subframe 22, which results in securing a space S between the upper surface of the lower subframe 22 and the lower surface of the hung material supporter 12, and the user can take off the hung material 4 through the space.

As described in the above, a use of the hanger of the present invention enables the hung material 4 simply, easily and securely to be hung on the hanger, in addition, simply and easily to be taken off, without any need for forming a skid-proof layer at the hanging portion, i.e., at the lower subframe. A use of the hanger of the present invention, in addition, enables the hanging on the lower subframe 22 to be made more quickly, when a user wants to hang a material 4 to be hung on the lower subframe 22, without any need for taking a specific care of dividing nearly equally of the hung material 4 in hanging, on both sides of the lower subframe 22. This is made possible, when the hung material 4 is hung on the lower subframe 22, the hung material 4 is inserted into the inside of the hollow space formed between the hung material supporter 12 of the hanger main frame 1 and the lower subframe 22 of the subframe 2, and thus the hanging condition is secured on the lower subframe 22. Furthermore, in the present invention, an effective usage of the hanger is possible to be made by hanging small articles such as a handkerchief, necktie and so on, on the upper surface 12 (*a*) of the hung material supporter 12 of the hanger main frame 1.

Furthermore, when the hung material 4 is hung between the lower subframe 22 and the hung material supporter 12 for a prolonged space of time, in some case a pressed pattern remains on the hung material 4. To prevent such pressed pattern, some cushion material can be contained in the hollow of the inside of the hung material supporter of the hanger main frame 1, and this can easily prevent the pressed pattern from remaining.

Figure 4:
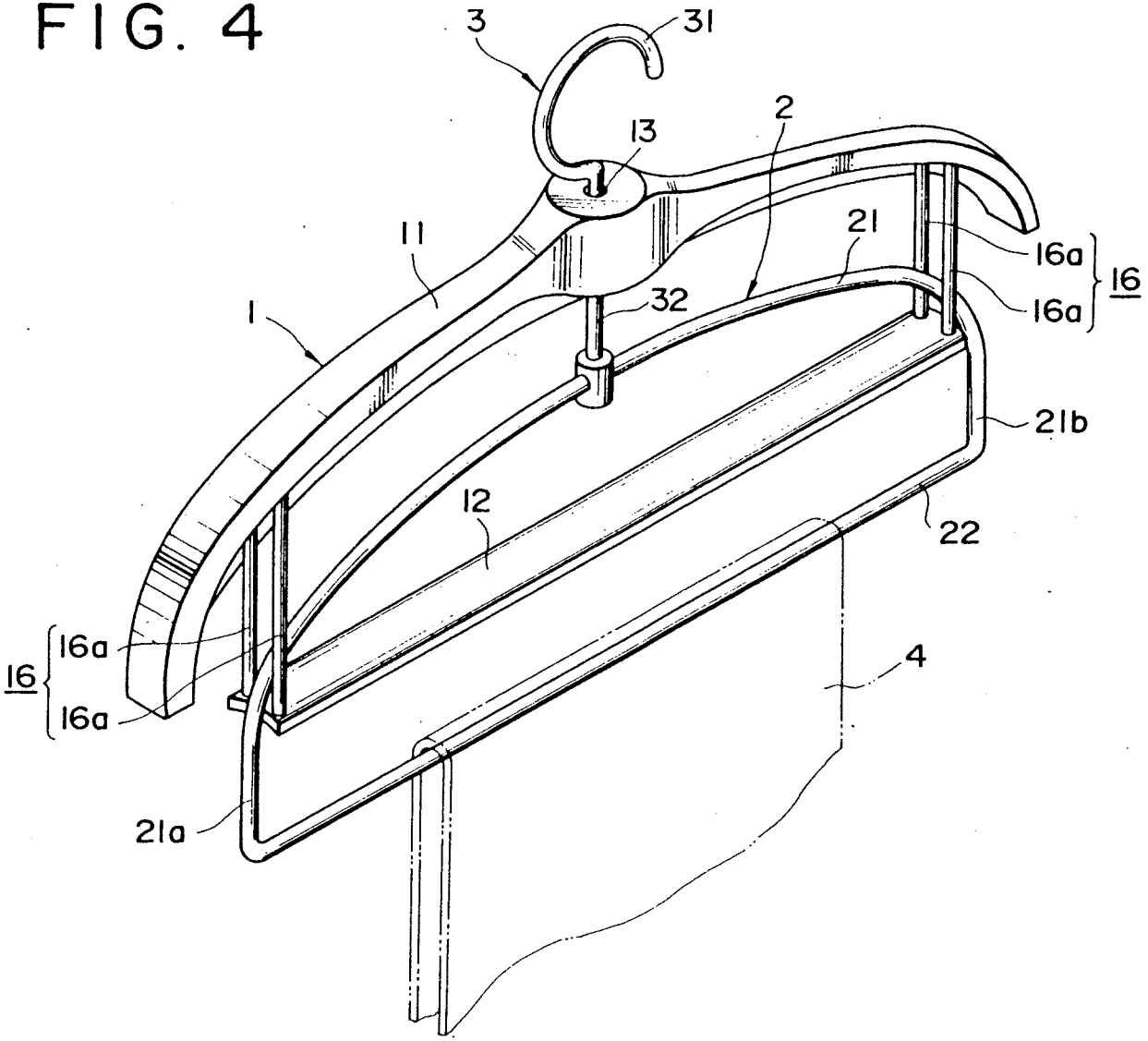
FIG. 4 is a perspective view of a hanger of another embodiment of the present invention.
Figure 5:
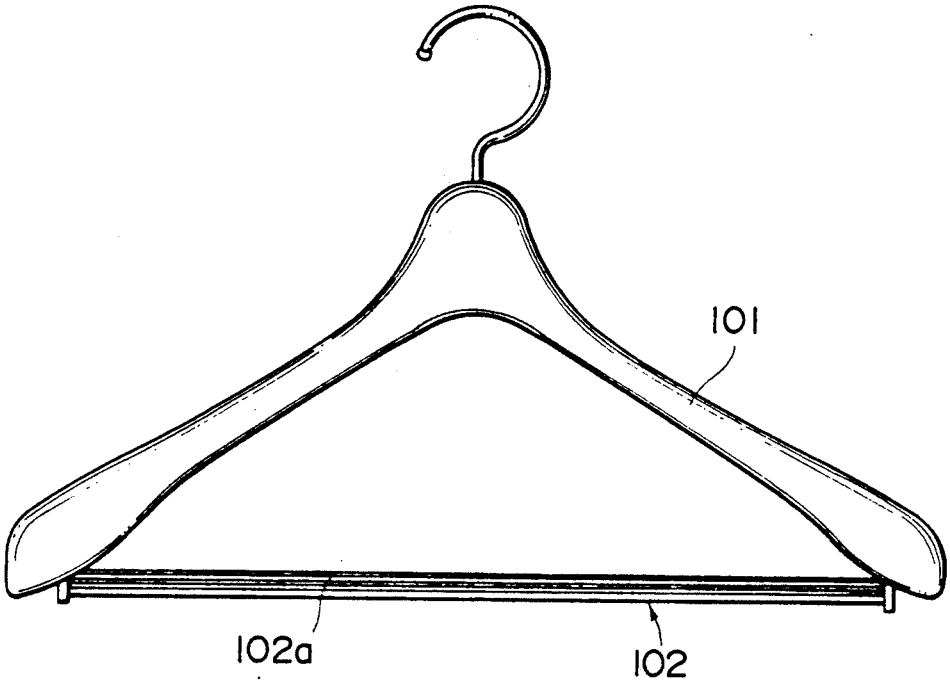
FIG. 5 PRIOR ART
FIG. 5 is a front view of a conventional hanger.
Figure 6:
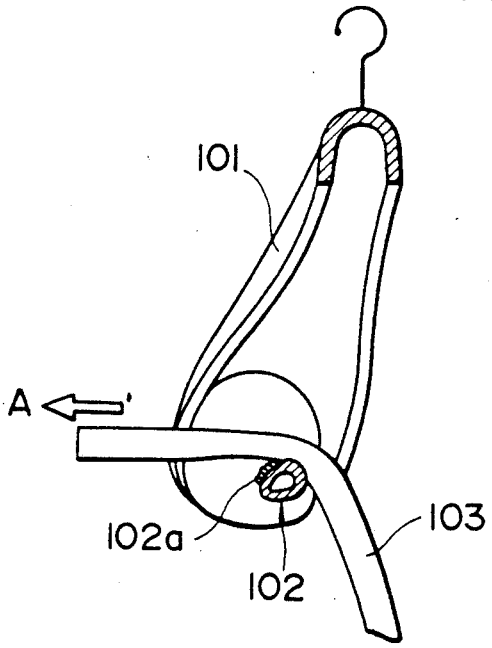
FIG. 6 PRIOR ART
FIG. 6 is a schematic, longitudinal cross-section of the hanger illustrated in FIG. 5.
Figure 7:
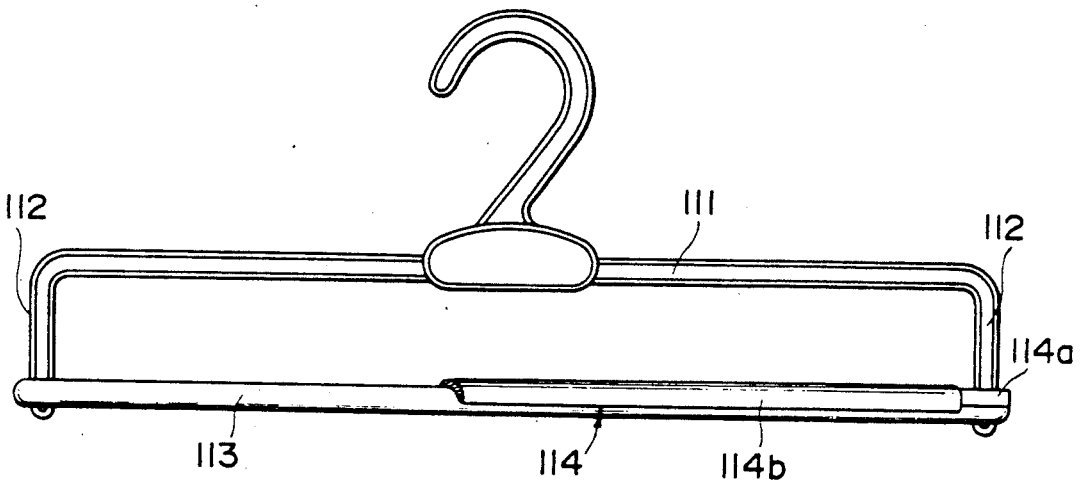
FIG. 7 PRIOR ART
FIG. 7 is a front view of a hanger of another prior art.

The second embodiment of the present invention will be explained referring to FIG. 4. A hanger of the second embodiment is a modification of the first one. That is, the jacket hanger 11 of the hanger main frame 1 is made of wood. At both the left and right ends of the lower surface of the jacket hanger 11, a pair of linkage rods 16 and 16, composed of a set of two rods 16 (*a*) and 16 (*a*) are protruded downwards, respectively, separated with a small given interval (about 10 to 20 mm), and to the vertical direction from the hang r. Moreover, at the lower portion of each of the linka rods 16 and 16, a hung material supporter 12 with a arrow-width plate of hung material supporter 12 is m unted. On the other hand, the subframe 2 is incorporat d as a unit composed of the respective thin rod of the pper subframe 21 and lower subframe 22 and vertical ype linkages 21 (*a*) and 21 (*b*), at the same time, the subfr me 2 is mounted by a hanging hook 3 on its central par of the upper frame 21.

The hanger main frame 1 and the subframe 2 a assembled as freely sliding up and down, i.e., movabl downwards with their own-weight, in such a way that the both ends of the upper subframe 21 of the subframe 2 is made penetrate through the space between the rods 16 (*a*) and 16 (*a*) formed, respectively, at the linkage rods 16 and 16 of the left and right of the hunger main frame 1, and the vertically extending portion 32 of the hanging hook 3 is made penetrate through the penetrating hole 13 formed on the jacket hanger 11.

In the same way as in the first embodiment, the lower subframe 22 of the subframe 2 and the hung material supporter 12 of the hanger main frame 1 assures a space S, on which the hung material 4 can be inserted and hung, between the upper surface of the lower subframe 22 and the lower surface of the hung material supporter 12, when the hanger main frame 1 is in an upwards moving position to the subframe 2, on the contrary, when the hanger main frame 1 is in a downwards moving position to the subframe 2, the hung material supporter 12 can press down, the hung material 4 hung on the lower subframe 22, from the upper part. In this connection, the method of usage of and effect of the hanger of the second embodiment is the same as in the first embodiment.

I claim:

1. A device for hanging a jacket and trousers, comprising:

a main frame having an upper portion shaped to fit inside the jacket from shoulder to shoulder and a lower portion vertically spaced apart from and extending in the same direction with said upper portion, said upper portion having a vertically extending through hole in the center thereof;

a subframe having an upper part disposed between said upper and lower portions of said main frame and a lower part adapted for hanging the trousers, said lower part being vertically spaced apart from said upper part and disposed beneath said lower portion of said main frame; and a hook member having an end portion fixedly secured to said upper part of said subframe and a vertical extending portion slidably inserted through said through hole with the other end thereof being protruded from said through hole and formed into a hook, so that said subframe is movable relative to said main frame between a lower position where there is formed a space between said lower portion of said main frame and said lower part of said subframe to permit the trousers to be inserted therethrough and an upper position where said lower part of said subframe is engaged by said lower portion of said main frame to nip the trousers hung on said lower part of said subframe therebetween.

* * * * *